US007458923B1

(12) United States Patent
Chou

(10) Patent No.: US 7,458,923 B1
(45) Date of Patent: Dec. 2, 2008

(54) RIDING TRAINER

(75) Inventor: Ming-Fu Chou, Taichung (TW)

(73) Assignee: King I Tech Corporation, Taichung (TW)

( * ) Notice: Subject to any disclaimer, the term of this patent is extended or adjusted under 35 U.S.C. 154(b) by 0 days.

(21) Appl. No.: 11/751,780

(22) Filed: May 22, 2007

(51) Int. Cl.
*A63B 26/00* (2006.01)

(52) U.S. Cl. ..... 482/142; 25/35 R

(58) Field of Classification Search ..... 482/142; 272/30, 53.1; 35/29 R; 54/1
See application file for complete search history.

(56) References Cited

U.S. PATENT DOCUMENTS 1,671,162 A * 5/1928 Peters ..... 472/97
3,997,979 A * 12/1976 Turner ..... 472/29
4,519,787 A * 5/1985 Williams ..... 446/313
5,085,425 A * 2/1992 Collins et al. ..... 472/97
5,180,338 A * 1/1993 Pinto ..... 472/96
5,429,515 A * 7/1995 Greenwood ..... 434/247
5,531,645 A * 7/1996 Collins ..... 472/97
6,210,286 B1 * 4/2001 Ohara et al. ..... 472/97
6,404,626 B1 * 6/2002 Low et al. ..... 361/686
6,488,640 B2 * 12/2002 Hood et al. ..... 601/23
6,616,456 B1 * 9/2003 Nalty et al. ..... 434/247
6,964,614 B1 * 11/2005 Tsai ..... 472/58
7,121,831 B2 * 10/2006 Hojo et al. ..... 434/247

* cited by examiner

*Primary Examiner*—Lori Amerson
(74) *Attorney, Agent, or Firm*—Egbert Law Offices

(57) ABSTRACT

The riding trainer structure includes a foundation, a drive motor, a first drive gear, a vertical rocker, a swinging seat frame, a second drive gear and a vertical guide set. The first drive gear is screwed onto the standing support, and a first drive wheel is eccentrically arranged at one side of the first drive gear. The bottom of the vertical rocker is screwed onto the foundation for horizontal swinging. A limit guide portion is placed at one side of the vertical rocker. The second drive gear driven by the first drive gear can rotate synchronously, and an eccentric second drive wheel of the second drive gear drives the vertical guide set, enabling the top of latch rod to drive the swinging seat frame vertically. The swinging amplitude of the vertical rocker could be changed to achieve better swinging strength and stability.

3 Claims, 10 Drawing Sheets

RIDING TRAINER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to fitness equipment, and more particularly to innovative fitness equipment which is a riding trainer.

2. Description of Related Art Including Information Disclosed Under 37 CFR 1.97 and 37 CFR 1.98

The riding trainer is a new type of fitness equipment used to simulate horse riding. The activity is a natural physical exercise promoting metabolism and making the individual slimmer and healthier.

The riding trainer is highly recognized by the users since it differs a lot from traditional sports and fitness devices, e.g. treadmills and oval track steppers. Physical exercise and amusement are achieved through swinging on the trainer. The riding trainer can operate simply and conveniently, presenting bright market prospects and potential.

As for currently available riding trainers with financial backing, the internal functional structure is almost the same, apart from specific patterns and configuration modes. As a whole, the structural design of riding trainer is not perfected due to the short time-to-market for the products. Thus, there is room for improvement. So, the objective and direction of this industry is to develop innovative and applicable structures with continuous R&D efforts.

Therefore, the inventor has provided the present invention of practicability after deliberate design and evaluation based on years of experience in the production, development and design of related products.

BRIEF SUMMARY OF THE INVENTION

There is enhanced efficacy of the present invention as follows.

A first drive wheel 32 is eccentrically arranged at one side of the first drive gear 30, and the swinging amplitude of vertical rocker 40 could be adjusted by simply changing the eccentric position of the first drive wheel 32, thereby achieving optimum cost-effectiveness and industrial performance through different structures.

The bottom of the vertical rocker 40 is screwed onto the foundation 10, and the bottom 43 is extended over the first drive gear 30, so the vertical rocker 40 could be located at optimum height and provided with a proper swinging arm, thus ensuring optimum swinging strength and stability for swinging seat frame 50, further improving the performance of the riding trainer A.

The vertical guide set 70 contains a positioning base 71, a guide base 72, a slide bar 73 and a latch rod 74. The optimum vertical swinging behavior of the swinging seat frame 50 could be achieved through stable sliding of slide bar 73 via the positioning base 71.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
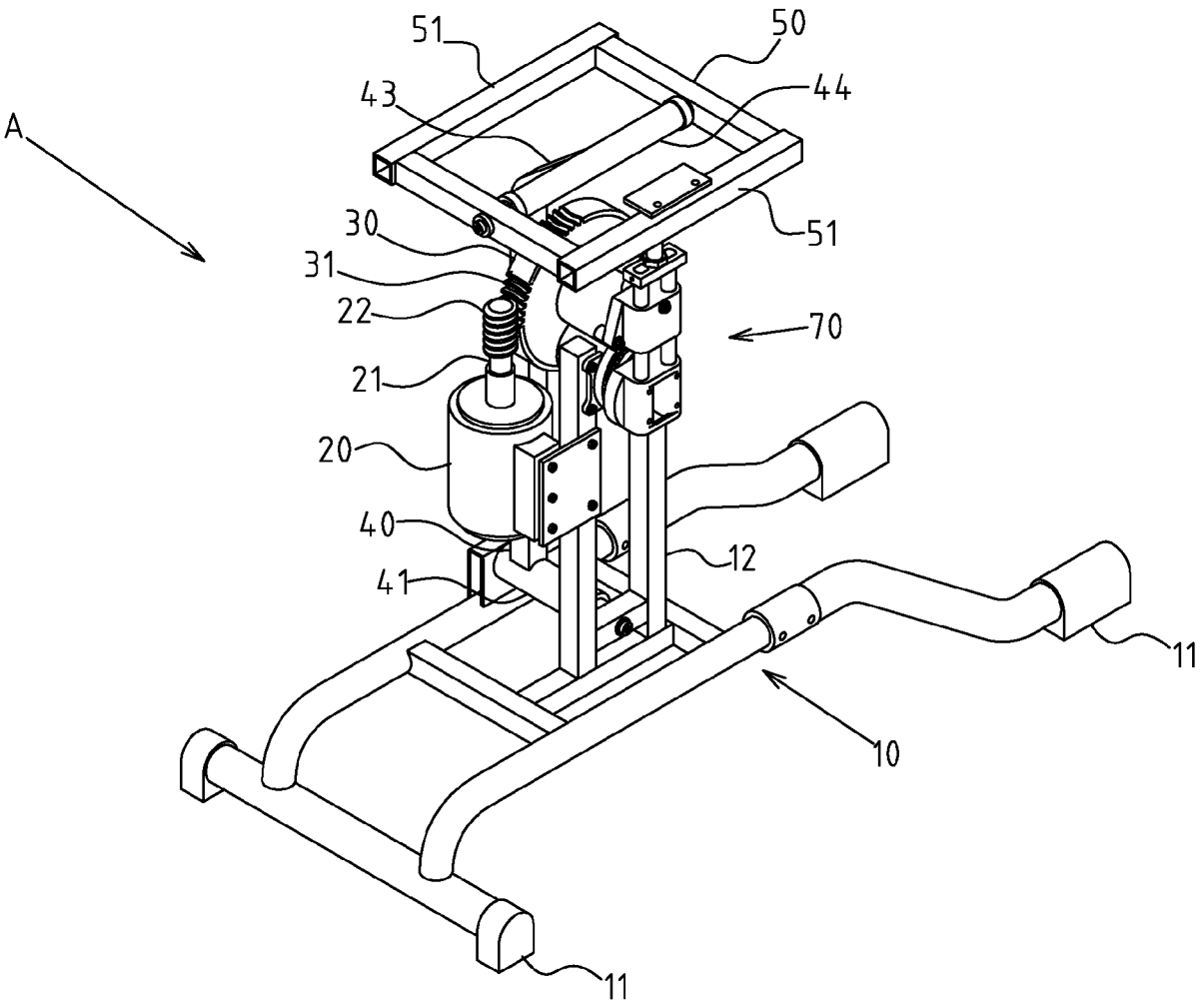
FIG. 1 shows an assembled perspective view of the present invention.
Figure 2:
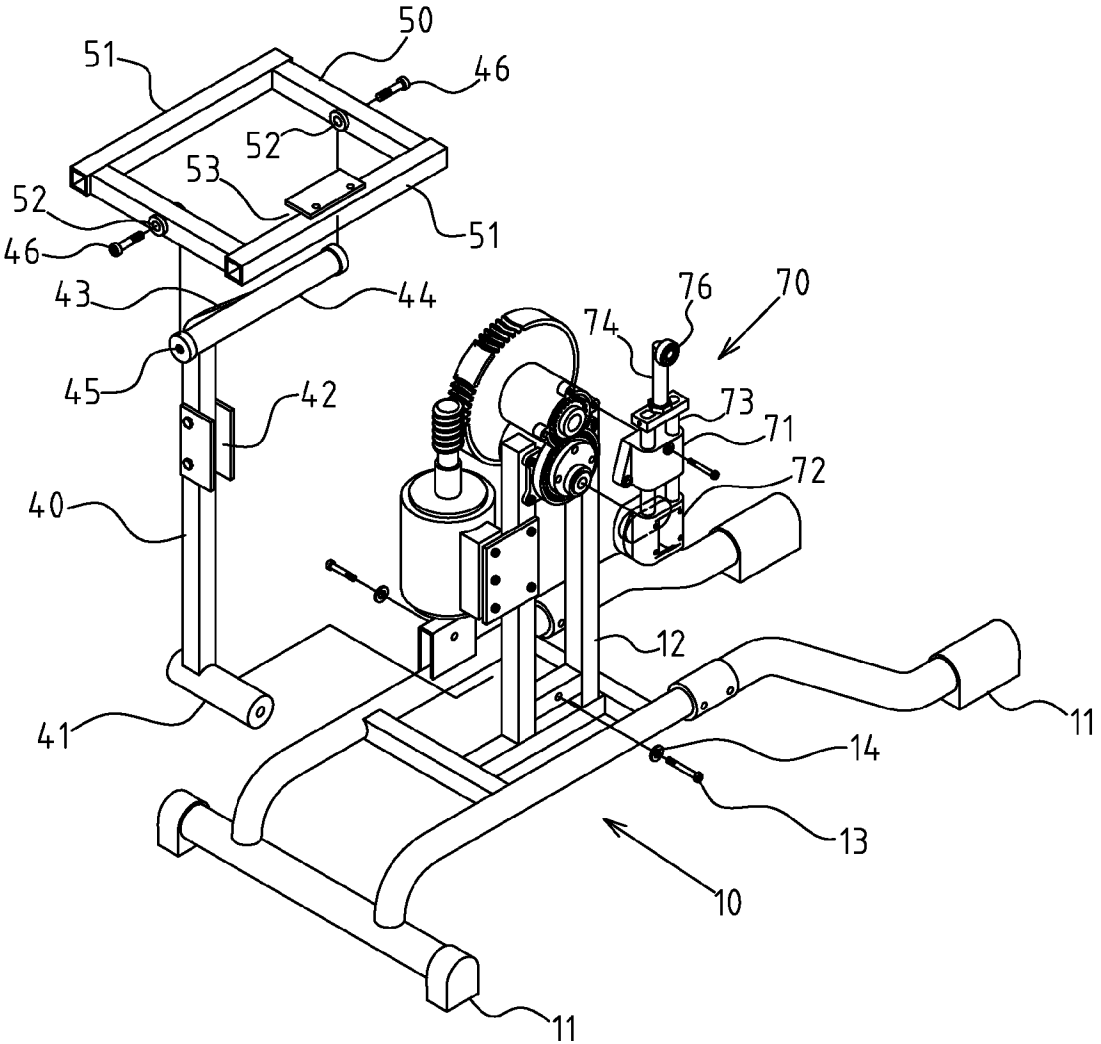
FIG. 2 shows a partially exploded perspective view of the present invention.
Figure 3:
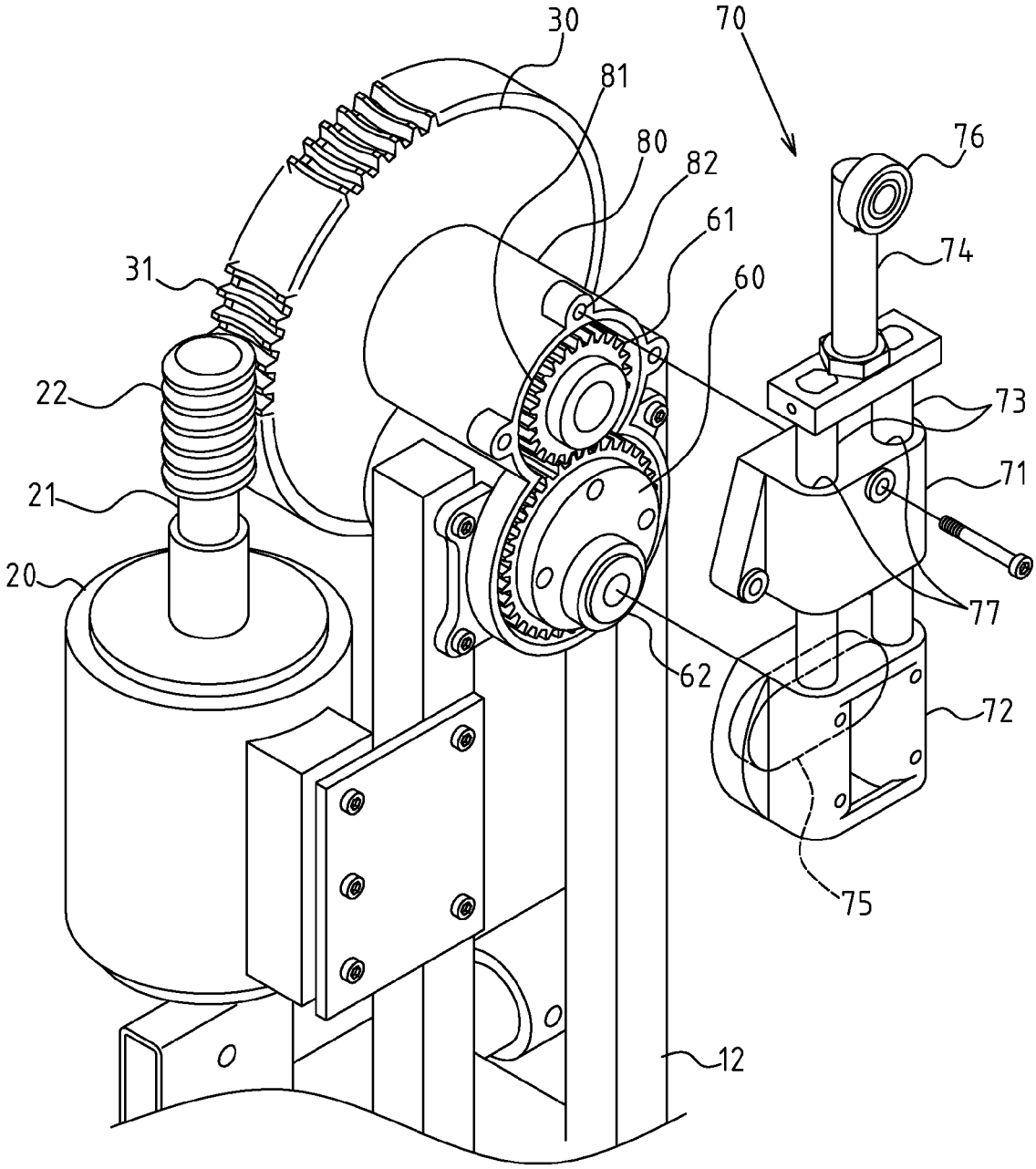
FIG. 3 shows a partially enlarged perspective view of FIG. 2.
Figure 4:
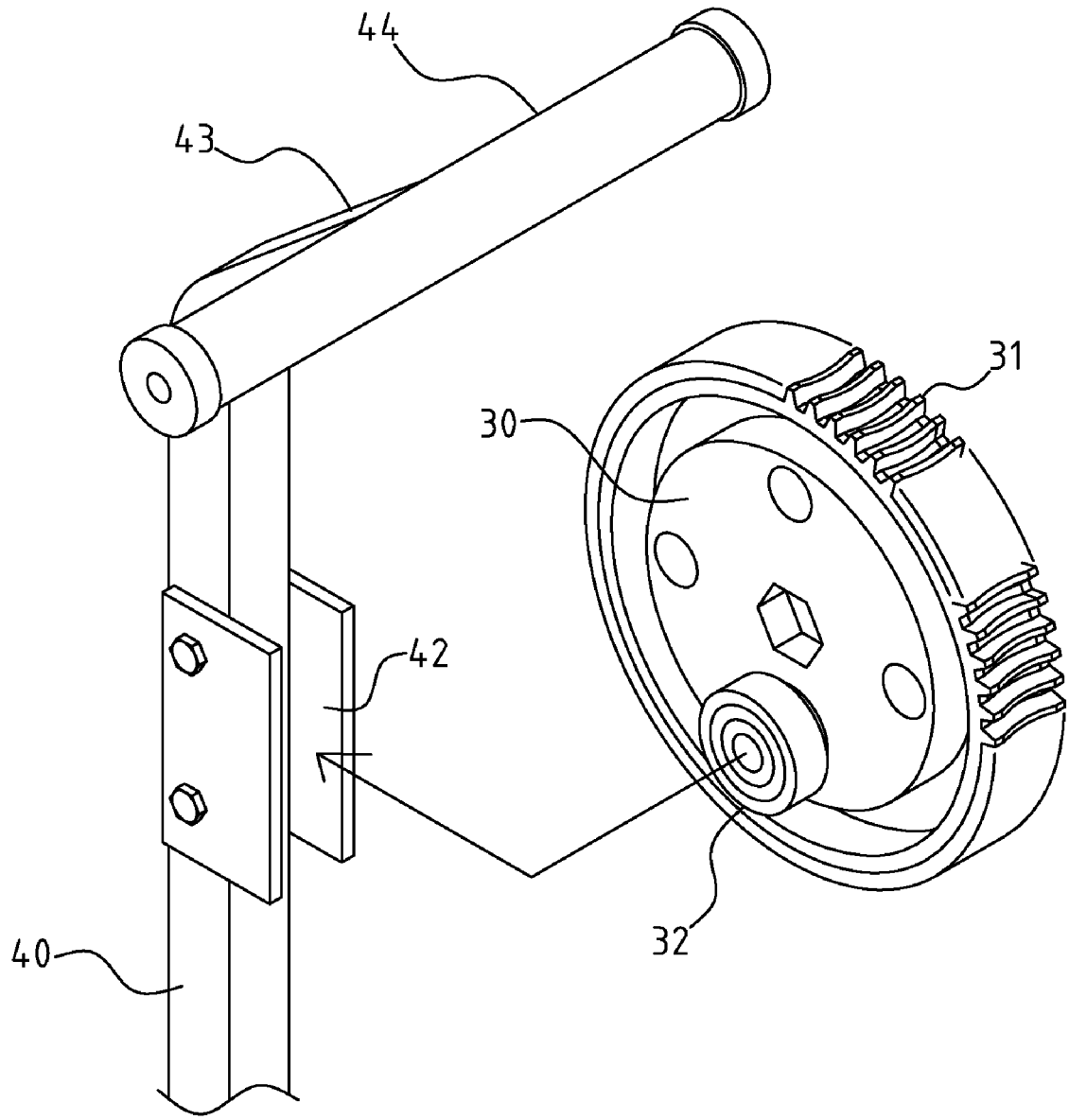
FIG. 4 shows a perspective view of the present invention when the first drive wheel of the first drive gear is adapted to the limit guide portion of the vertical rocker.
Figure 5:
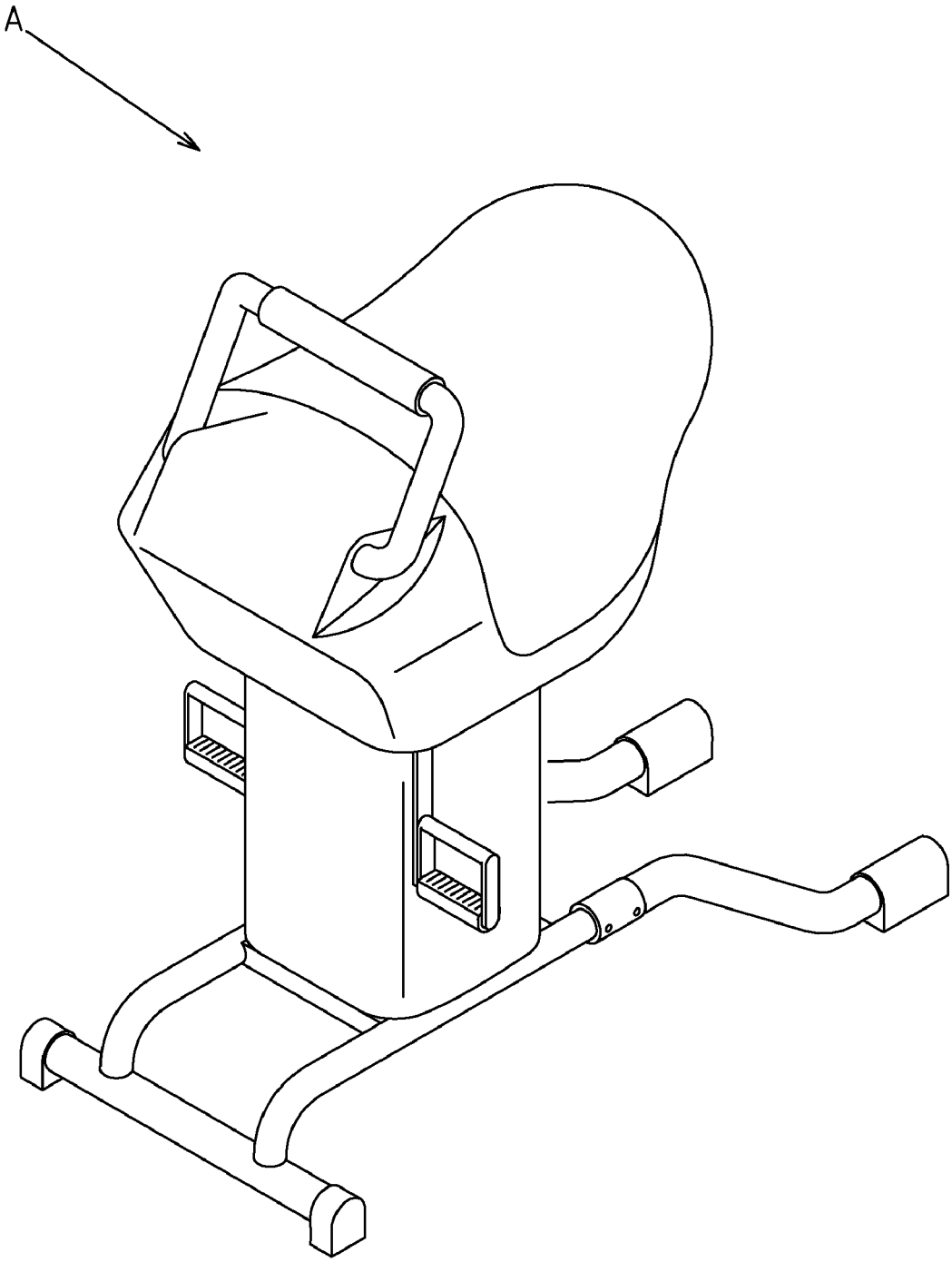
FIG. 5 shows a perspective view of the application of the riding trainer of the present invention.

The features and the advantages of the present invention will be more readily understood upon a thoughtful deliberation of the following detailed description of a preferred embodiment of the present invention with reference to the accompanying drawings.

FIGS. 1-5 depict preferred embodiments of the riding trainer of the present invention. The embodiments are provided only for explanatory purposes.

The riding trainer A comprises a foundation 10, which contains a grounding support 111 and a standing support 12. A drive motor 20 is assembled at a predefined height of the standing support, and a worm-driven portion 22 is located at the power output end 21 of the drive motor 20. The first drive gear 30 is screwed onto the standing support 12, while the tip edge 31 is coupled with the worm-driven portion 22 at the power output end 21 of drive motor 20. A first drive wheel 32 is eccentrically arranged at one side of the first drive gear 30. A vertical rocker 40 is provided with a shaft support 41 at the bottom, which is fastened to the foundation 10 through the compound gasket 14 of the bolt 13, so that the vertical rocker 40 swings horizontally. A limit guide portion 42 is placed at one side of the vertical rocker 40 corresponding to the first drive wheel 32 of the first drive gear 30. The top 43 of the vertical rocker 40 protrudes to a predefined location over the first drive gear 30.

A swinging seat frame 50 has a middle section screwed onto the top of the vertical rocker 40, so that two sides 51 of the swinging seat frame 50 can swing vertically. A cross bar 44 is placed at top 43 of the vertical rocker 40, and tap holes 45 are placed at both sides of the cross bar 44 so that the swinging seat frame 50 is formed by a rectangular frame. Two punch holes 52 are set at both sides of the swinging seat frame 50 corresponding to the tap holes 45 of the cross bar 44 and are used for screwing via bolt 46.

A second drive gear 60 is flexibly screwed onto the standing support 12. The second drive gear 60 could be driven by the first drive gear 30 via the drive gear set 61, so that it can rotate synchronously with the first drive gear 30. A second drive wheel 62 is eccentrically arranged at one side of the second drive gear 60. A ladle stand 80 is assembled externally onto the second drive gear 60 and drive gear set 61, while an opening 81 is set at one side of the ladle stand. The ladle stand also has a locating hole 82 for fixation of positioning base 71 of the vertical guide set 70.

A vertical guide set 70 contains a positioning base 71, a guide base 72, a slide bar 73 and a latch rod 74. The positioning base 71 is used for positioning the vertical guide set 70. The guide base 72 is provided with a groove 75 adapted to the second drive wheel 62 of the second drive gear 60. The slide bar 73 passes through the punch hole 77 of the positioning base 71, while the top of slide bar 73 is linked to the latch rod 74 and the bottom of the slide bar 73 is linked to the guide base 72. A free wheel 76 is placed at one side of the top of latch rod 74, so that a c-shaped groove 53 on the swinging seat frame 50 could be arranged for insertion of the free wheel 76, thus forming a flexible linkage state.

Based upon above-specified structures, the present operation operates as follows.

Figure 8:
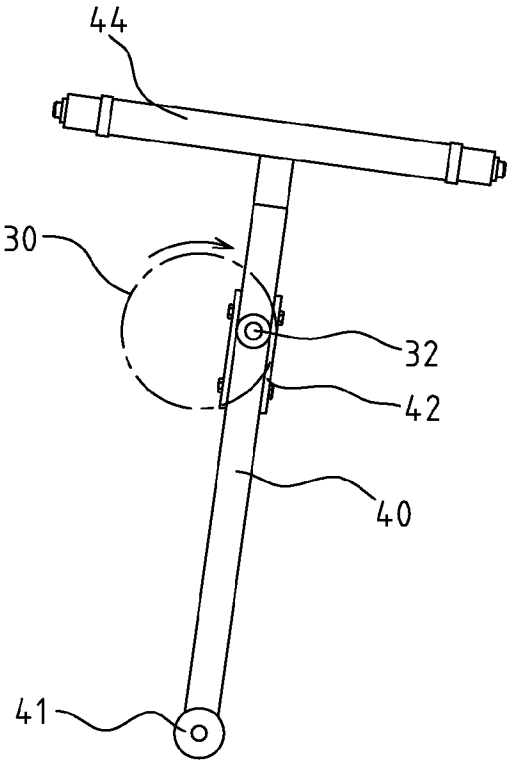
FIG. 8 shows a third schematic view of the operation of the vertical rocker of the present invention.
Figure 7:
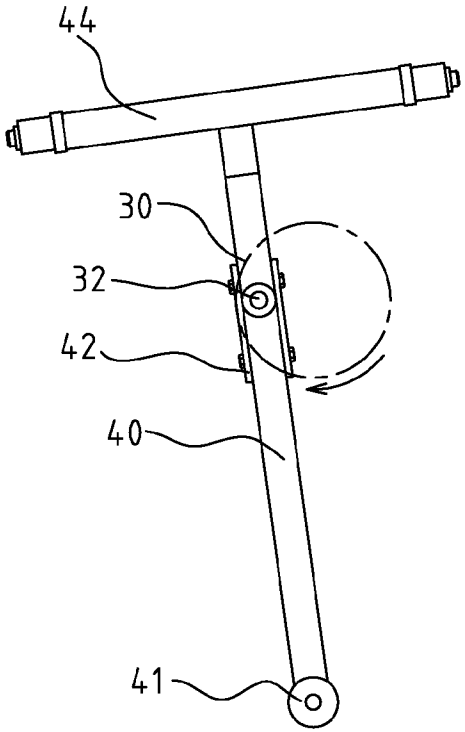
FIG. 7 shows a second schematic view of the operation of the vertical rocker of the present invention.
Figure 6:
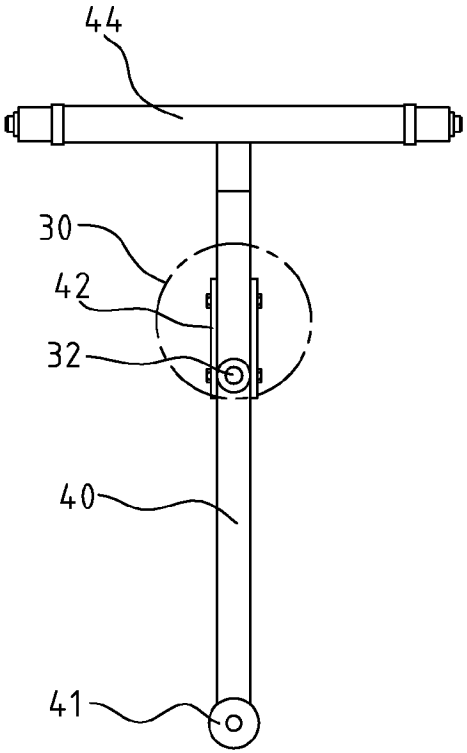
FIG. 6 shows a schematic view of the operation of the vertical rocker of the present invention.
Figure 9:
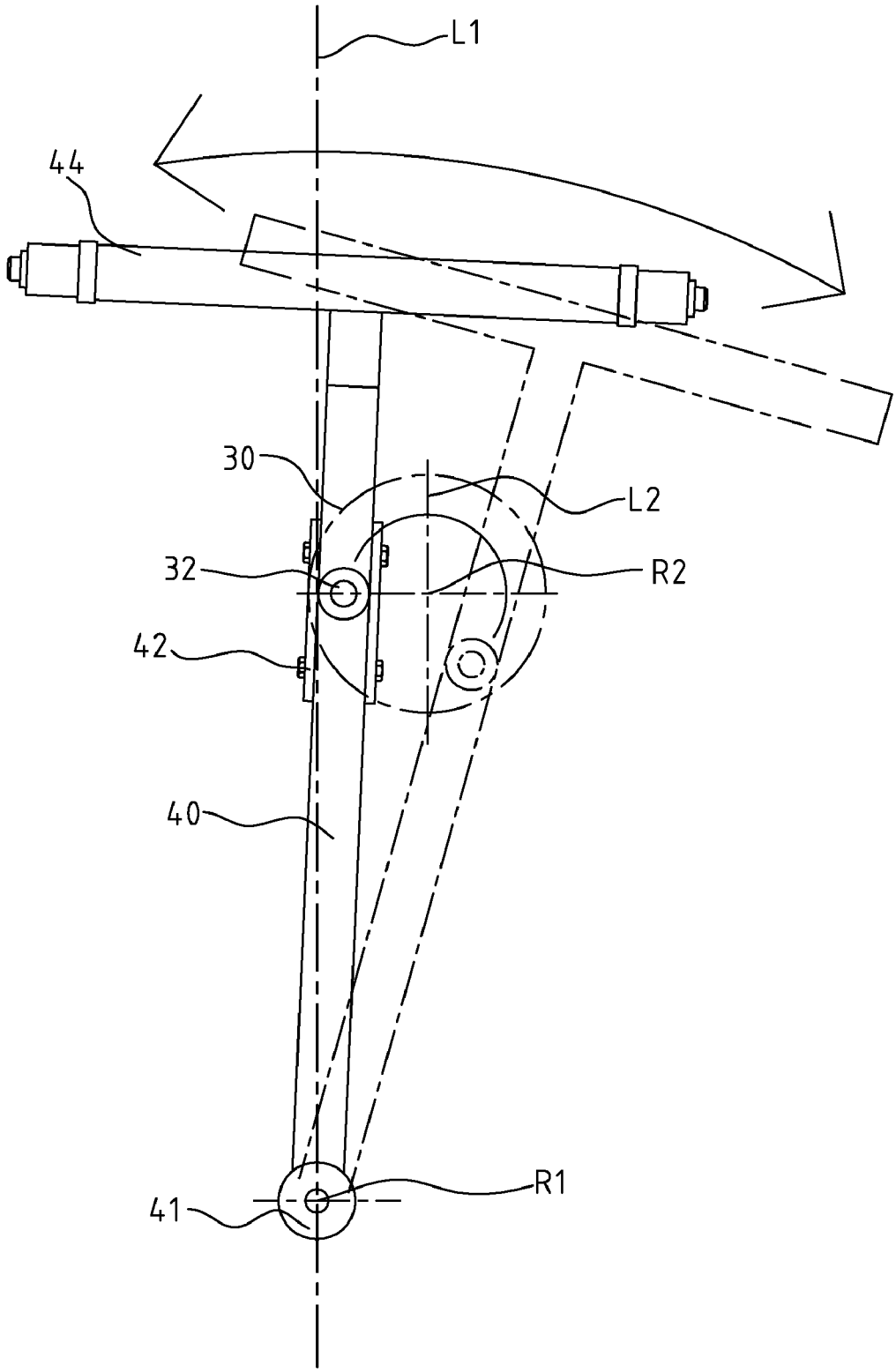
FIG. 9 shows still another schematic view of the operation of the vertical rocker of the present invention.

Referring to FIGS. 6-8, when the first drive gear 30 rotates, the first drive wheel 32 is driven to shift within the limit guide portion 42. The vertical rocker 40 is screwed securely onto the shaft support 41, so that the vertical rocker 40 swings horizontally. Referring also to FIG. 9, when the axial point R1 of shaft support 41 meets the axial line L1, and when the axial point R2 of first drive gear 30 meets the axial line L2, these two axial lines run in parallel, so that axial points of shaft support 41 and first drive gear 30 are misaligned, allowing increase in the swinging angle, and selectively meeting user demands.

Figure 12:
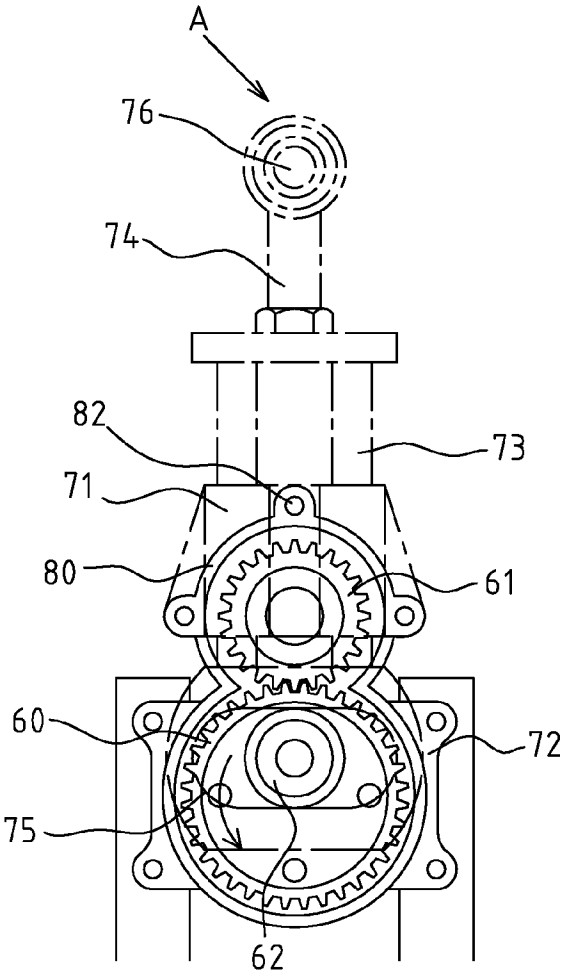
FIG. 12 shows a third schematic view of the operation of the vertical guide set of the present invention.
Figure 11:
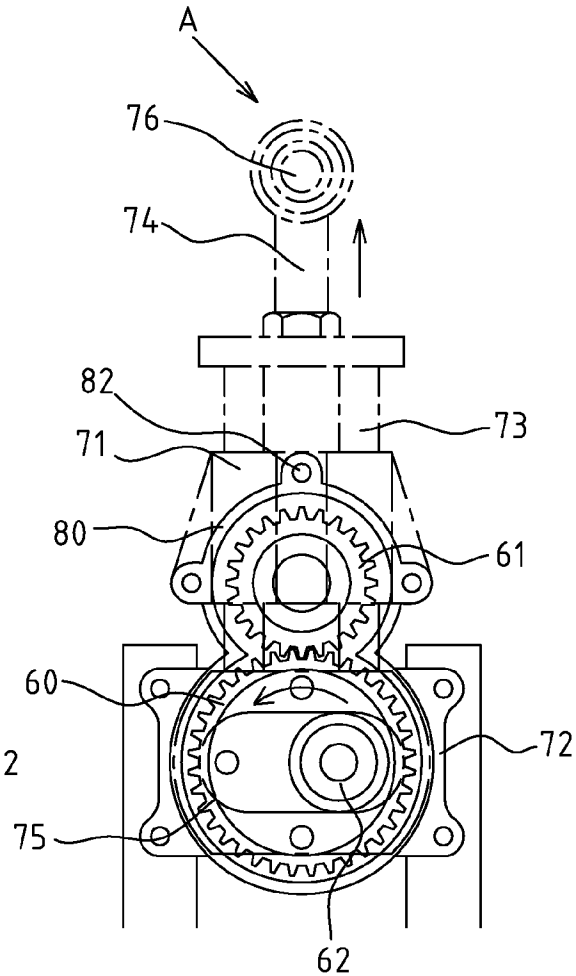
FIG. 11 shows a second schematic view of the operation of the vertical guide set of the present invention.
Figure 10:
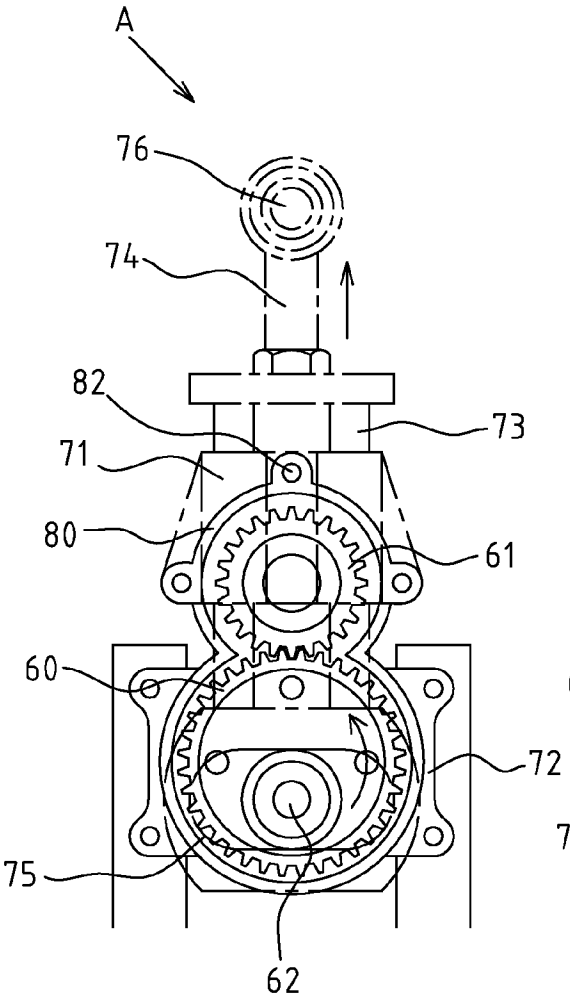
FIG. 10 shows a schematic view of the entire operating path of the riding trainer of the present invention.
Figure 13:
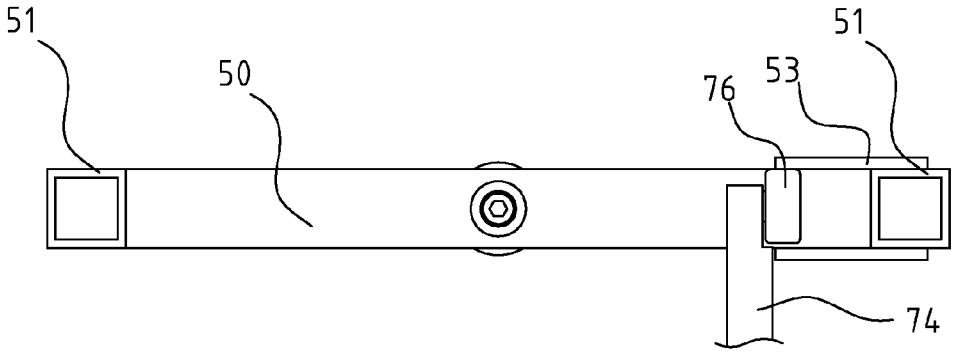
FIG. 13 shows a first schematic view of the operation of the swinging seat frame of the present invention.
Figure 14:
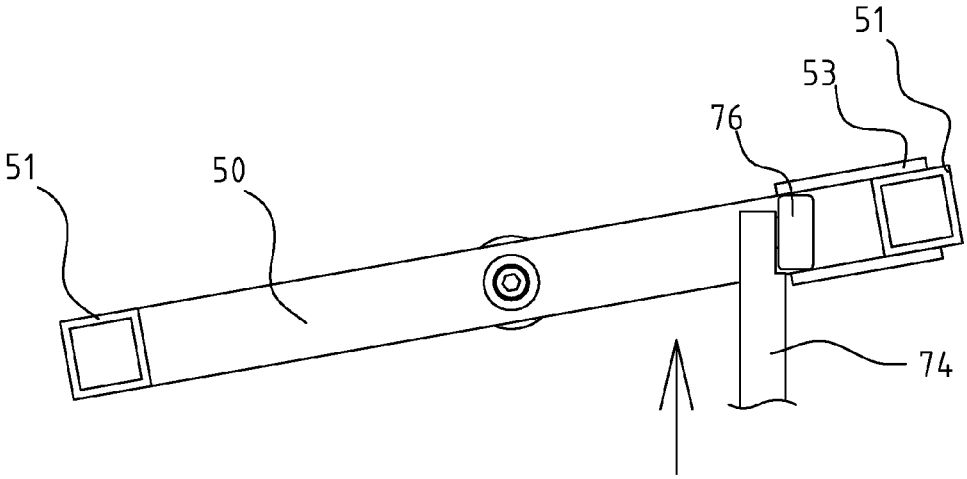
FIG. 14 shows a second schematic view of the operation of the swinging seat frame of the present invention.
Figure 15:
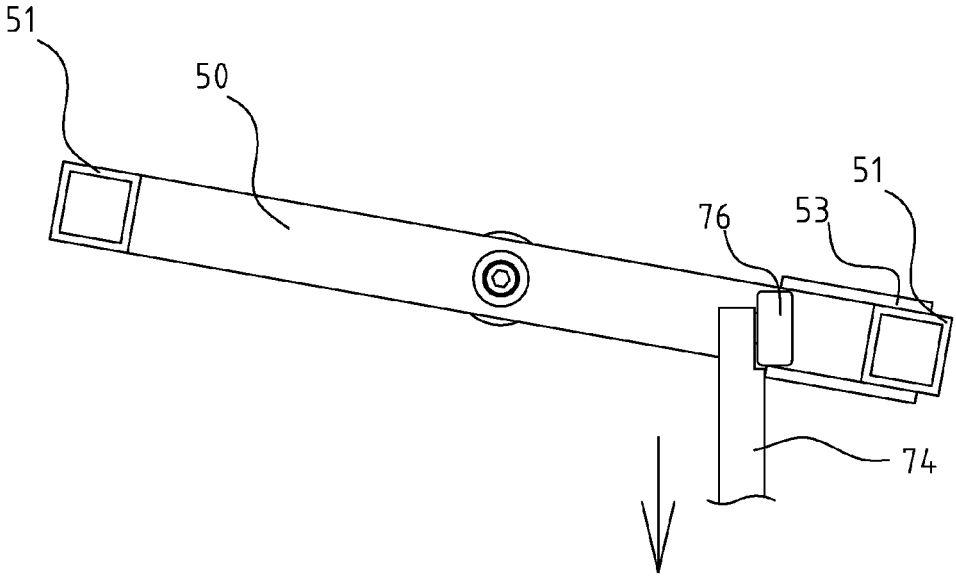
FIG. 15 shows a third schematic view of the operation of the swinging seat frame of the present invention.

Referring to FIGS. 10-12, when the drive gear set 61 rotates, the second drive gear 60 is driven along with the second drive wheel 62. A ladle stand 80 is externally assembled onto the second drive gear 60 and drive gear set 61. An opening 81 is placed at one side of the ladle stand, and the ladle stand is also provided with a locating hole 82 for fixation of positioning base 71 of the vertical guide set 70. When the second drive wheel 62 shifts eccentrically in the groove 75, the vertical guide set 70 is driven to shift vertically, thus driving the free wheel 76 on top of the latch rod 74. Referring also to FIGS. 13-15, when the latch rod 74 shifts vertically, the free wheel 76 could be inserted into a ⊂-shaped groove 53 on the swinging seat frame 50, thus achieving a flexible linkage state, and also allowing both sides 51 of the swinging seat frame 50 to swing vertically.

Figure 16:
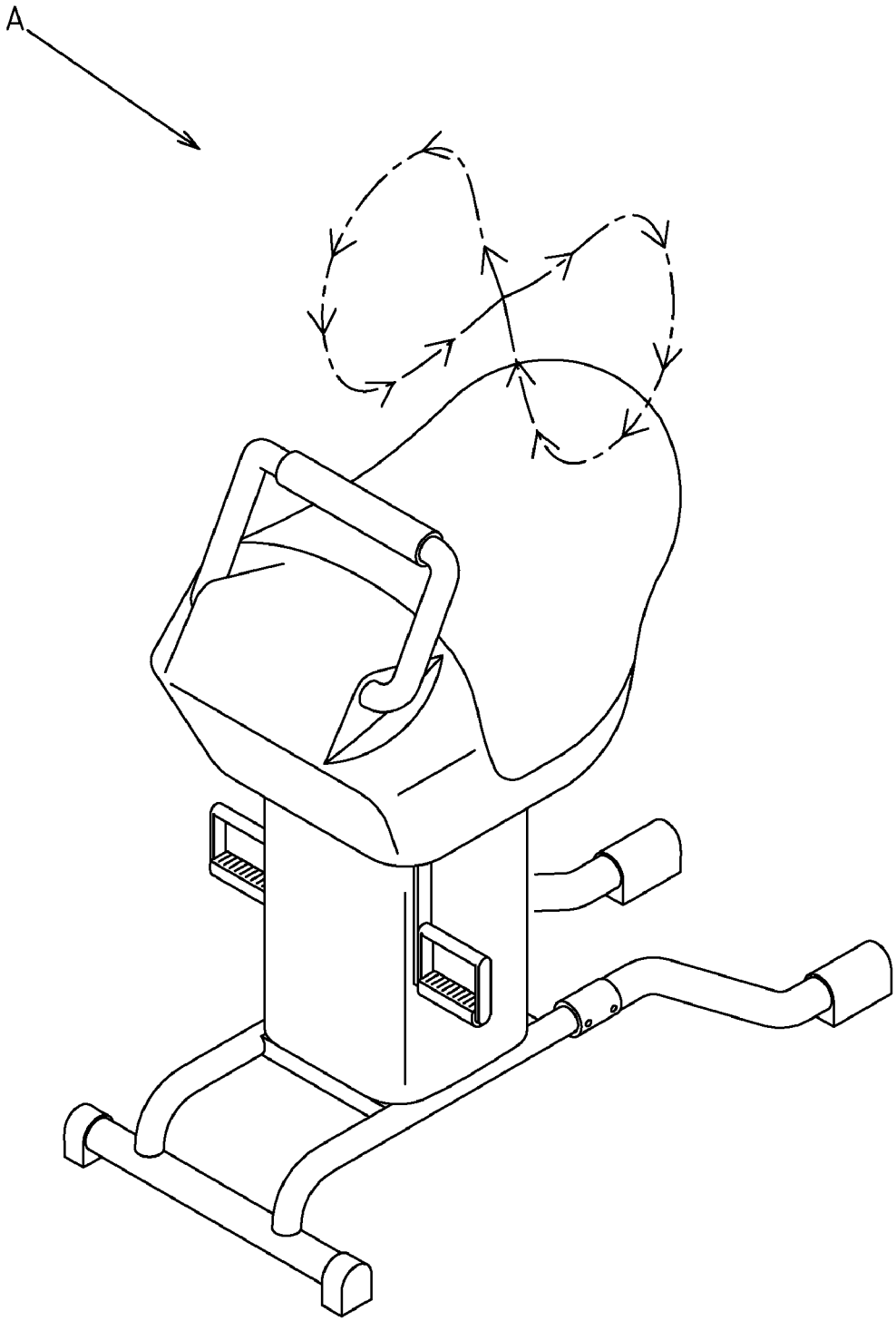
FIG. 16 shows a perspective view of the operation of the vertical guide set of the present invention.

Referring to FIG. 16, the riding trainer A may swing in the form of a similar ∞ pattern, helping to achieve the effect of riding a horse.

I claim:

1. A riding trainer apparatus comprising:

a foundation having a grounding support and a standing support;

a drive motor affixed at a desired height on said standing support, said drive motor having a worm-driven portion at power output end thereof;

a drive gear screwed onto the standing support, said first drive gear having a tip edge coupled to said worm-driven portion of said drive motor, said first drive gear having a first drive wheel eccentrically arranged at one side thereof;

a vertical rocker having a shaft support with a bottom fastened to said foundation so as to allow said vertical rocker to swing horizontally, said vertical rocker having a limit guide portion on one side thereof so as to correspond to the said first drive wheel, said vertical rocker having a top protruding to a predefined location over said first drive gear;

a swinging seat frame having a middle section screwed onto said top of said vertical rocker so as to allow said swinging seat frame to swing vertically;

a second drive gear flexibly screwed onto said standing support, said second drive gear drivable by said first drive gear by a drive gear set such that said second drive gear rotates synchronously with said first drive gear, said second drive gear having a second drive wheel eccentrically positioned on one side thereof;

a vertical guide set having a positioning base and a guide base and a slide bar and a latch rod, said positioning base suitable for positioning said vertical guide set, said guide base having a groove receiving said second drive wheel, said slide bar passing through a punch hole in said positioning base, said slide bar having top linked to said latch rod and bottom linked to said guide base, one side of said top of said latch rod corresponding to said swinging seat frame being freely linked; and a free wheel positioned on one side of said top of said latch rod, said swinging seat frame having a C-shaped groove receiving said free wheel therein so as to form a flexible linkage.

2. The riding trainer apparatus of claim 1, further comprising:

a cross bar positioned at said top of said vertical rocker, said cross bar having tap holes formed at opposite ends thereof, said swinging seat frame forming a rectangular frame, said swinging seat frame having a pair of punch holes corresponding in location to said tap holes, said pair of punch holes and said tap holes each receiving a bolt therein.

3. The riding trainer apparatus of claim 1, further comprising:

a ladle stand externally affixed onto said second drive gear and to said drive gear set, said ladle stand having an opening at one side thereof, said ladle stand having a locating hole receiving said positioning base.

* * * * *